US007624474B1

(12) United States Patent
Cho

(10) Patent No.: US 7,624,474 B1
(45) Date of Patent: Dec. 1, 2009

(54) PORTABLE EXTRACTOR CLEANING APPARATUS

(75) Inventor: Sung K. Cho, Arlington, TX (US)

(73) Assignee: Tacony Corporation, Fenton, MO (US)

( * ) Notice: Subject to any disclaimer, the term of this patent is extended or adjusted under 35 U.S.C. 154(b) by 0 days.

(21) Appl. No.: 12/271,397

(22) Filed: Nov. 14, 2008

(51) Int. Cl.
*A47L 7/00* (2006.01)

(52) U.S. Cl. ..... 15/320; 15/327.2; 15/347

(58) Field of Classification Search ..... 15/320, 15/327.2, 347; *A47L 7/00*
See application file for complete search history.

(56) References Cited

U.S. PATENT DOCUMENTS

| | | | | |
|---|---|---|---|---|
| 3,939,527 | A * | 2/1976 | Jones | 15/353 |
| 4,466,155 | A | 8/1984 | Grave | 15/321 |
| 4,696,075 | A | 9/1987 | Grave | 15/321 |
| 5,114,574 | A | 5/1992 | Barry | 210/137 |
| 5,151,181 | A | 9/1992 | Barry | 210/338 |
| 5,566,422 | A * | 10/1996 | Geyer | 15/320 |
| 5,589,080 | A | 12/1996 | Cho et al. | 210/791 |
| 6,061,868 | A | 5/2000 | Moritsch et al. | 15/320 |
| 7,240,394 | B2 | 7/2007 | Kegg et al. | 15/320 |
| 2005/0125936 | A1 * | 6/2005 | Spraakman | 15/320 |

OTHER PUBLICATIONS

Powr-Flite (Commercial Floor Care Equipment) "Upright Extractor" Operators Manual and Parts List, Model PFX 1350 Series, Apr. 2008; pp. 1-10.

* cited by examiner

*Primary Examiner*—David A Redding
(74) *Attorney, Agent, or Firm*—Charles D. Gunter, Jr.

(57) ABSTRACT

A portable extractor apparatus is shown which includes a wheel mounted base having a solution tank for dispensing and recovering cleaning solution. A cleaning head communicates with the solution tank and contacts the surface to the cleaned for dispensing and recovering cleaning solution. A fluid pump circulates cleaning solution in a path between the solution tank and the cleaning head. A vacuum motor provides a vacuum source for the cleaning head for suctioning the surface being cleaned. The solution tank has mounted thereon both an initial multi-component filter assembly which initially filters incoming solution being circulated to the solution tank and a distinct final filter component which removes smaller particles from the solution being re-circulated from the tank. The solution tank bottom wall has a profile which improves the efficiency of the final filter component.

11 Claims, 6 Drawing Sheets

PORTABLE EXTRACTOR CLEANING APPARATUS

BACKGROUND OF THE INVENTION

1. Field of the Invention

The present invention relates to a portable machine for cleaning planar surfaces, such as carpeted floors, upholstery, wall coverings and the like, as well as hard floor surfaces, and finds particular application in such machines where hot or cold cleaning liquids are sprayed onto the surface and are then removed by suction.

2. Description of the Prior Art

Cleaning systems that circulate and spray liquids are widely used for cleaning carpets, upholstery, fabric and wall coverings, as well as for hard surfaces such as tile and ceramics. Cleaning systems of this type which circulate and spray liquids often include a solution tank of liquid cleaning solution supported on a wheel mounted base or framework. The framework also supports a liquid pump for circulating the cleaning solution and one or more vacuum motors for recovering the solution and returning the used solution to a recovery tank. Many of these systems use a "cleaning head" which is part of a "cleaning wand" to spray liquid cleaning solution toward the surface being cleaned, for example, while the cleaning head is being pushed across the floor. In many such systems, the cleaning head is not integral with the base or framework, but rather is coupled to the solution tank through pliable hosing and the associated cleaning wand, which is thus is movable independently. A vacuum source creates a high velocity airstream through the wand head which draws the dispensed liquid from the surface being cleaned upwardly through the wand head and through the pliable hosing to the solution tank, thereby extracting soil, debris and other foreign matter to clean the surface.

A variety of devices of the above type are known in the relevant industries. For example, a commercially available line of carpet extractors of the above general type is sold as the "PFX1350 Series Extractors" by Powr-Flite®, a Tacony Company, 3101 Wichita Court, Fort Worth, Tex., 76140.

Alternatively, a surface cleaning apparatus can be self-contained, in the sense of providing a wheel supported housing that incorporates the necessary motors and contains the cleaning fluid, and further incorporates the cleaning tool head as a part of the same housing. In other words, the cleaning head is attached to the machine housing and rolls across the floor with the housing. A number of these type machines will also be familiar to those skilled in the relevant arts. For example, two such commercially available machines are sold as the "PFX3S and the PFX 900S Series Extractors" by Powr-Flite®, a Tacony Company, 3101 Wichita Court, Fort Worth, Tex., 76140.

The aforementioned devices, whether of the hose and wand variety, or of the self-contained housing variety, all utilize vacuum motors to draw up the dispensed cleaning solution from the surface being cleaned so that the used cleaning solution can be returned to a solution recovery tank. Depending upon the particular machine design, either one or two tanks may be used to dispense cleaning solution and then recover the dirty, used solution. In the case of the two tank machines, the majority of the dirty water and cleaning solution is recovered and then discarded. There are several disadvantages with such an arrangement, however. For example, where two tanks are used, they typically provide about twice the tank volume that is needed to hold the actual volume of treatment fluid. Another disadvantage is that the user has to carry the recovery tank when full to a disposal outlet, such as a sink, for disposal of the recovered solution and then refill the separate solution tank.

Because of these and other disadvantages, recent cleaning machines of this general type, e.g., carpet extractors, have been available in the marketplace which are designed to recycle the extracted cleaning solution for reuse. These machines utilize only a single, multi-purpose, dispensing and recovery "solution tank." The result is the elimination of the additional "recovery tank", as well as the need to dispose of the recovered cleaning solution in the tank several times during the cleaning operation. The one-tank system also reduces significantly the number of times the user has to stop and refill the solution tank.

A critical aspect of the design of the one-tank cleaning system of the type under consideration is the design of the solution tank itself, and of the filtration system used with the solution tank. The solution recovery tank is provided with one or more types of filter elements for straining dirt and debris from the cleaning solution. Obviously it is necessary to have an efficient filtration system in place to re-circulate and recycle the cleaning solution. The actual physical design of the solution tank itself can also impact upon the efficiency of the recovery and recycling operation.

A need exists, therefore, for a portable cleaning apparatus of the type which dispenses and then collects liquid cleaning solution from a surface being cleaned, which apparatus utilizes a single solution dispensing and recovery tank of optimum design.

A need also exists for such a cleaning apparatus which has incorporated therein an improved filtration system for filtering dirt and debris from the used cleaning solution prior to recirculating and reusing the cleaning solution on the surface being cleaned.

A need also exists for such a cleaning machine which is relatively simple in design and economical to manufacture.

SUMMARY OF THE INVENTION

An extractor apparatus which overcomes many of the perceived shortcomings of the prior art devices and practices is the subject matter of the present application. The portable extractor includes a wheel mounted base having at least a solution tank for dispensing and recovering cleaning solution. In a preferred embodiment of the invention, a cleaning wand is connected to the solution tank by pliable hosing, the cleaning wand having a cleaning head which contacts the surface to the cleaned for dispensing and recovering cleaning solution. A fluid pump circulates cleaning solution in a path between the solution tank and the cleaning head of the wand. A vacuum motor provides a vacuum source for the extractor apparatus, the vacuum source being in communication with the cleaning head of the wand for suctioning the surface being cleaned.

An improved filtration system is provided as a part of the solution tank for filtering recovered cleaning solution to be reused. The improved filtration system includes a first multi-component filter assembly in fluid communication with the head of the cleaning wand which acts as an initial stage filter. The first multi-component filter assembly is supported on a filter support which extends downwardly into the solution tank. The first multi-component filter assembly is used to filter larger particles such as larger dirt and debris particles from the cleaning solution entering the solution tank which acts as a final filter for the system. The improved filtration system also includes a second filter component mounted within the solution tank. The second filter component filters particles from the cleaning solution and dirt of a smaller size than the particles filtered from the first multi-component filter assembly.

Preferably, the first multi-component filter assembly includes an upper element which comprises a debris basket, the upper element supporting a lower element which comprises a fabric type disposable filter element. The preferred second filter component is a replaceable cartridge type filter element.

The preferred solution tank also features a redesigned profile which itself aids in the recovery and re-circulation operation. The solution tank has a top wall, a bottom wall and opposing sidewalls which together define a closed interior, and wherein the top wall includes openings for accessing both the first multi-component filtration assembly and the second filter component to allow replacement as needed. This arrangement allows the first multi-component filter assembly and the second filter component to be changed out independently of each other. The solution tank bottom wall also is designed to slope from a relatively higher horizontal plane to a relatively lower horizontal plane which is equipped with a drain opening. In one version of the apparatus, the solution tank bottom wall slopes from a relatively higher rearward extent to a relatively lower forward extent thereof, the forward extent containing a drain opening for the tank. This design of the tank bottom wall creates a depth difference in the tank interior, whereby the second filter component is mounted on the relatively higher region of the bottom wall where it contacts less dirt and debris collecting at the drain opening.

Additional objects, features and advantages will be apparent in the written description which follows.

DETAILED DESCRIPTION OF THE INVENTION

Figure 1:
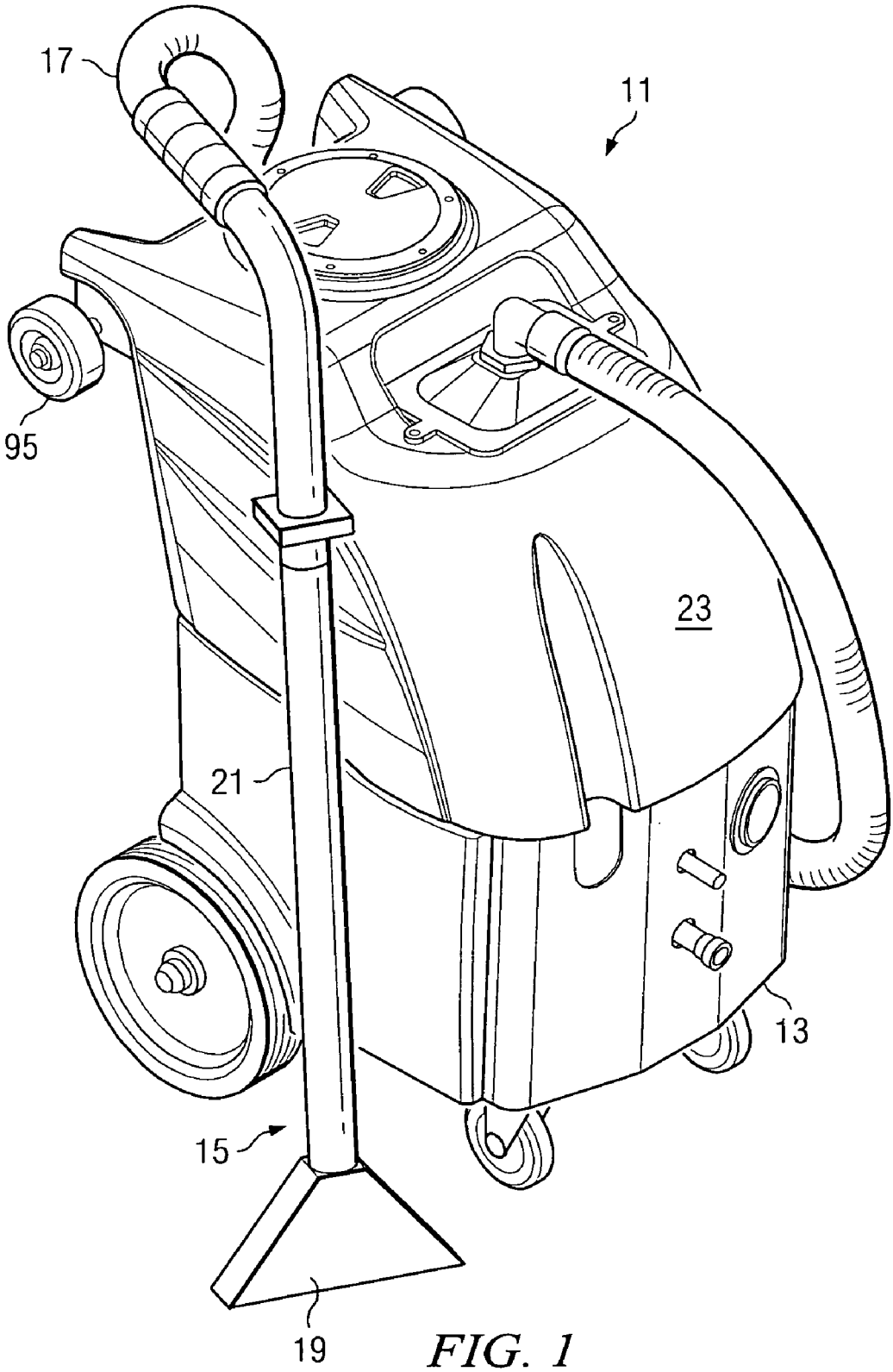
FIG. 1 is a perspective view of a portable carpet extractor employing the various features of the invention, showing the cleaning wand and the associated wheel supported base which houses the cleaning fluid solution tank, pump and vacuum source.

Turning to FIG. 1, there is shown an apparatus for cleaning a planar covered surface of the invention designated generally as 11. The surface to be cleaned can be, for example, a carpeted surface, a wall covering, upholstery, or the like. The surface can also be a hard surface, such as a tile or ceramic floor. In the preferred embodiment of the invention illustrated in FIG. 1, the apparatus 11 is a carpet extractor of the type used to remove soil from the carpeted surface by means of a hand held wand 15. It will be understood by those skilled in the relevant arts that many of the features of the invention which are to be described will also have applicability to extractor machines which feature an integrally mounted cleaning head which moves across the floor surface as the machine itself is moved back and forth.

As shown in FIG. 1, the particular portable extractor cleaning apparatus of the invention includes a wheel mounted base or framework 13 and a cleaning wand 15 connected to the base by means of pliable hosing 17. The wand is made up of a cleaning head 19 which is supported by a handle assembly 21. As will be familiar to those skilled in the art, the handle assembly 21 supports a cleaning fluid line and vacuum line which fluidly connect the head 19 with a cleaning solution tank 23 carried on the base 13.

Figure 2:
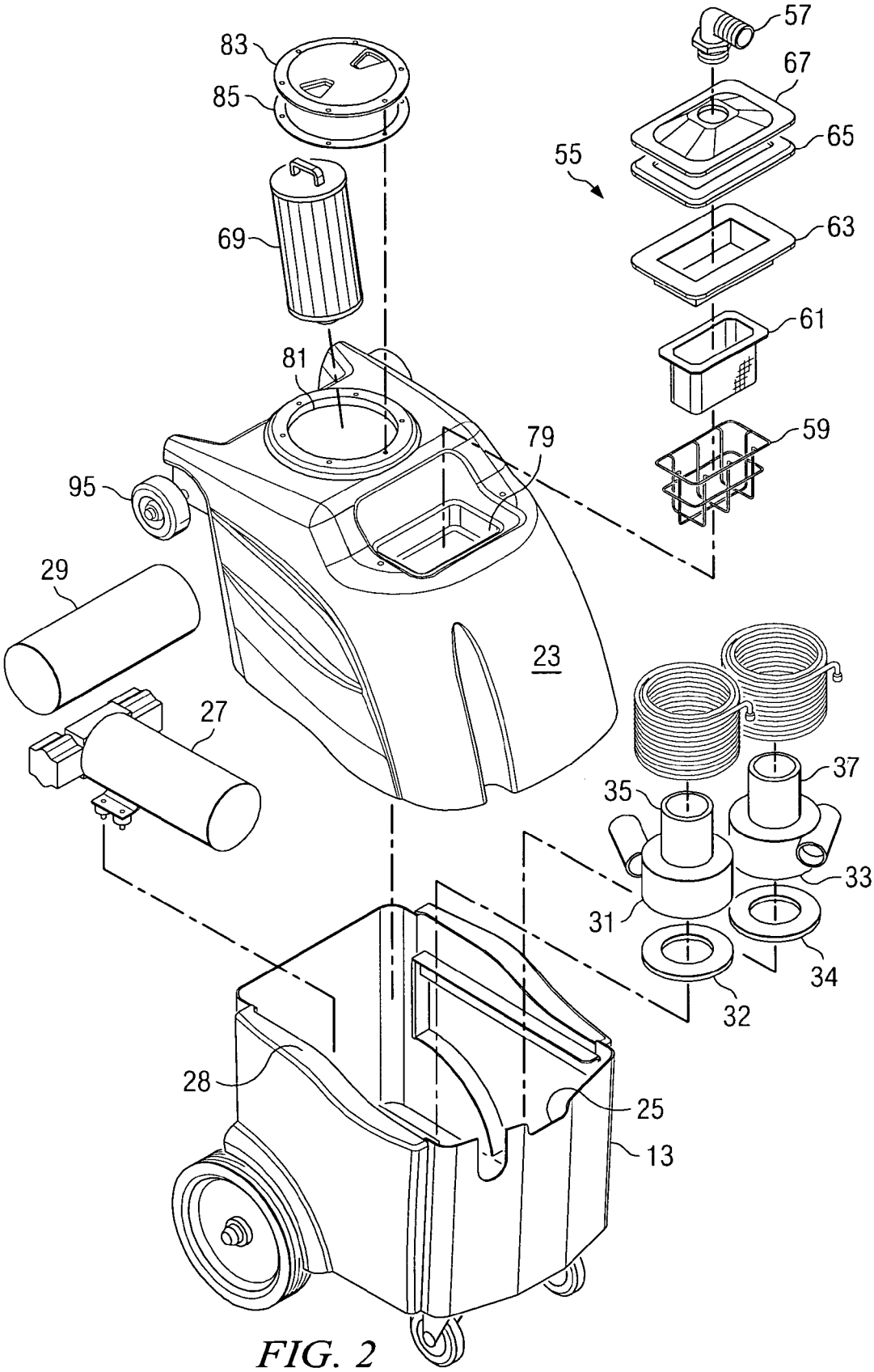
FIG. 2 is a simplified exploded view of the carpet extractor of FIG. 1, showing the principle components thereof.
Figure 4:
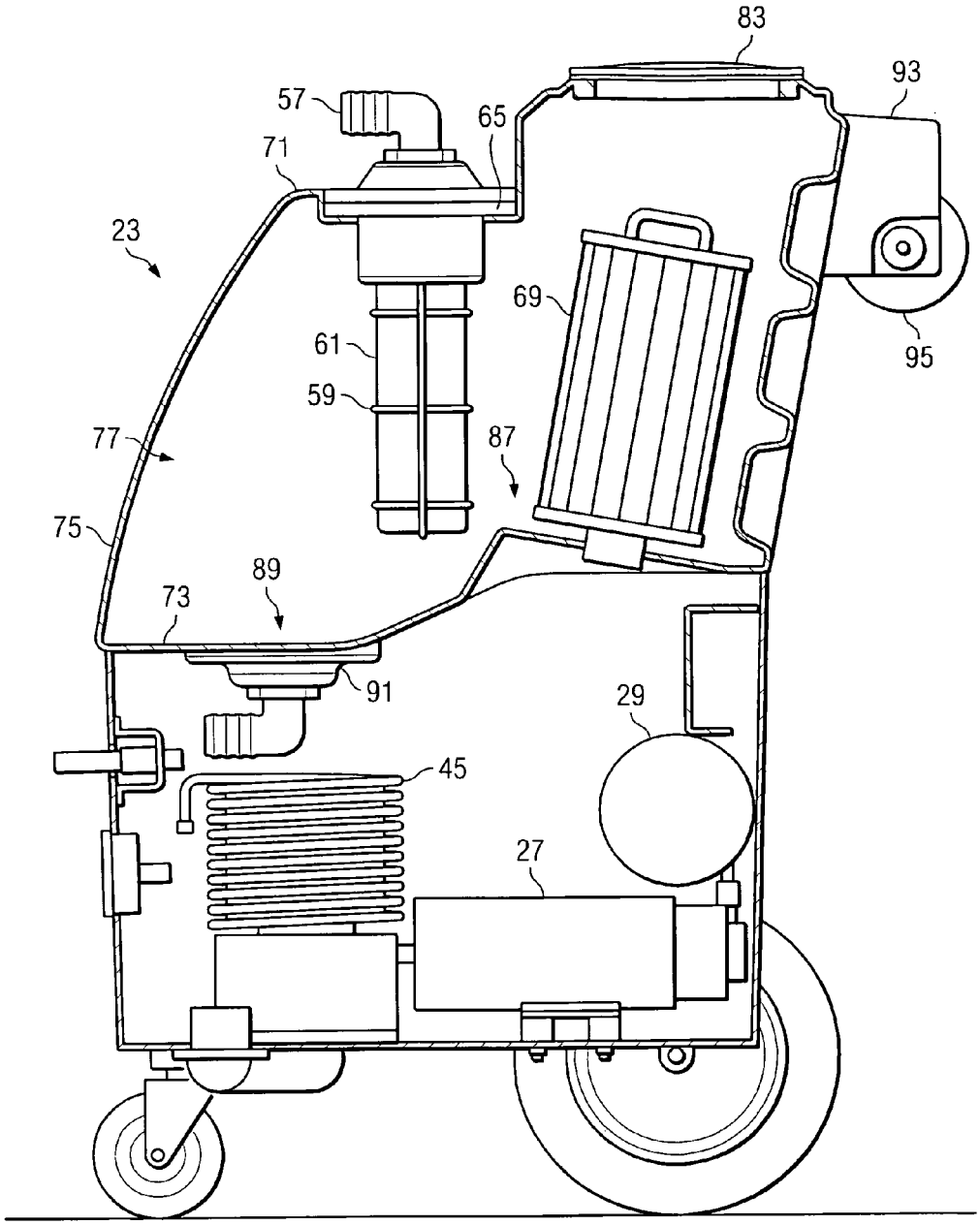
FIG. 4 is a simplified side view of the device of FIG. 1 showing the contour of the solution tank bottom wall and showing the location of the respective filtration elements which are used to filter the cleaning solution in the solution tank.

As better seen in FIGS. 2 and 4, the wheel mounted base 13 which makes up a part of the particular extractor illustrated actually supports a single solution tank 23 which dispenses cleaning solution and which also serves as a recovery tank for recovering dirty cleaning solution. The base 13 itself comprises a utility compartment (25 in FIG. 2) for housing a fluid pump 27 and a separate electrical solution heating component 29. The separate electrical heating component 29 is typically powered by the AC power source to the unit and may feature, for example, a resistive heating element. As shown in FIG. 2, the motor compartment 25 also houses one or more vacuum motors, in this case two motors 31, 33, which are seated on seals 32, 34. The vacuum motors 31, 33, in this case are 115 VAC 104 cfm, 3 stage vacuum motors. The described liquid pump 27 used for circulating the cleaning solution from the solution tank 23 and vacuum motors used for recovering cleaning solution and returning solution to the solution tank 23 are all conventional and will be familiar to those skilled in the relevant arts. The particular fluid lines used to circulate cleaning fluid between the principle components of the system are not shown, for simplicity's sake, and to better illustrate the particular novel points of the invention. Fluid circulation systems for devices of the type under consideration are described, for example, in issued U.S. Pat. Nos. 4,466,155, issued Aug. 21, 1984, to Grave; 4,696,075, issued Sep. 29, 1987, to Grave; 5,114,574, issued May 19, 1992, to Barry; 5,151,181, issued Sep. 29, 1992, to Barry; and 5,589,080, issued Dec. 31, 1996, to Cho et al.

The base 13 is provided as a unitary shell which serves as a chassis for installation of the operative components of the apparatus. The base has side covers (e.g. cover 28 in FIG. 2) which can be removed for ease of access to the interior of the apparatus for servicing the internal components.

Figure 3:
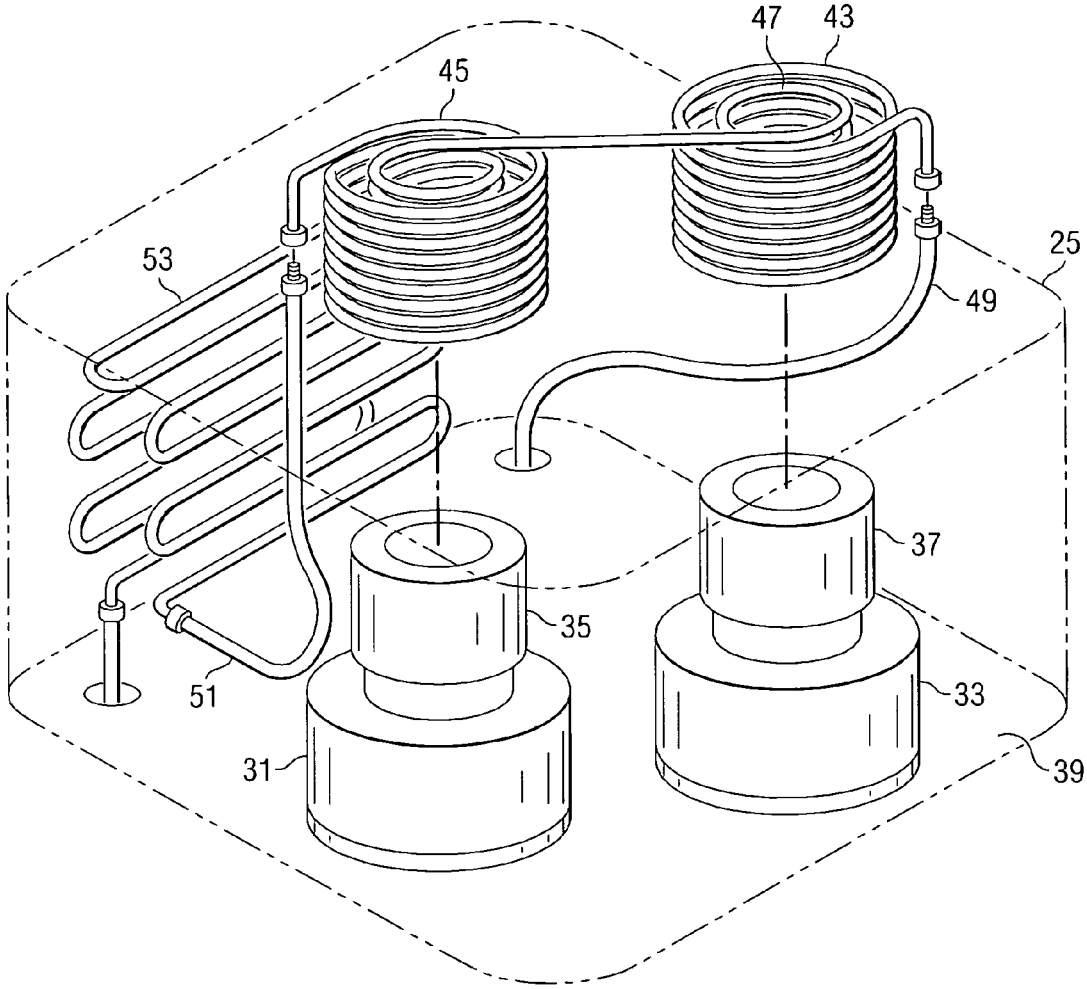
FIG. 3 is an isolated view of the vacuum motors which are located within a bottom compartment of the device, showing the associated heat exchange components thereof.

The vacuum motors 31, 33 comprise a vacuum source for the wand and wand head of the extractor apparatus 11 which vacuum source communicates with the cleaning head 19 of the wand 15 for suctioning the surface being cleaned. As seen in FIGS. 2 and 3, the base compartment 25 has a bottom compartment wall 39 onto which the vacuum motors 31, 33 are mounted in a vertical orientation within the interior of the compartment 25. Even though the particular motors are shown as being vertically mounted, it will be appreciated by those skilled in the relevant arts that the motors could be mounted in other orientations on the housing, for example, horizontally.

Figure 3A:
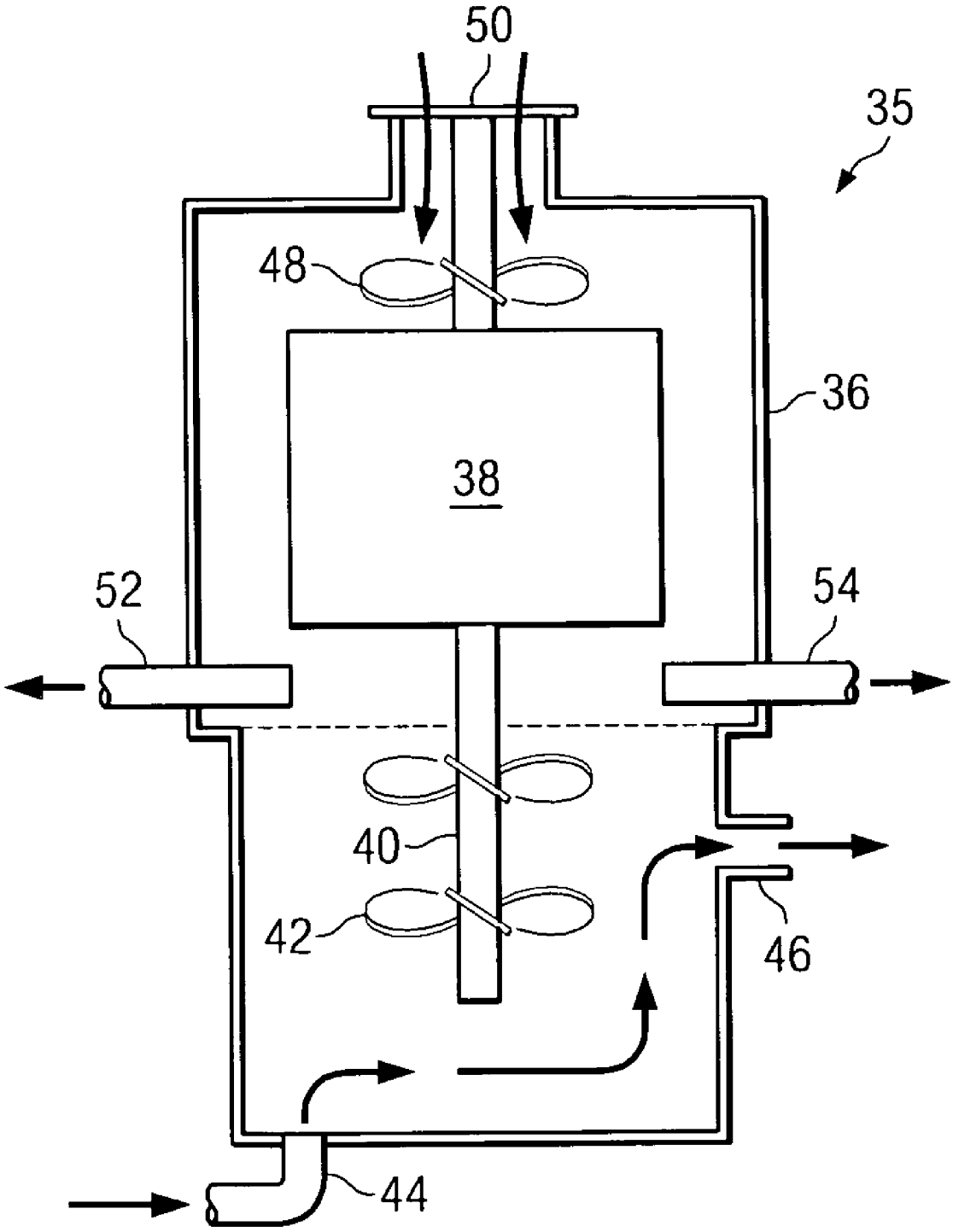
FIG. 3A is a simplified, schematic view of one of the vacuum motors used in the apparatus of the invention, showing the various air flow routes through the vacuum motor.

As illustrated schematically in simplified fashion in FIG. 3A, each vacuum motor, e.g., motor 35, has an outer case 36 which houses the electric motor 38, the output shaft 40 of which turns the fan blades 42. The resulting vacuum stream created within the interior of the case 36 is used to draw cleaning fluid into an inlet 44 and propel the fluid from the outlet 46. The outer case 36 also houses a separate cooling fan 48 which draws air into an air inlet 50, the air then passing around the electric motor 38, after which it is expelled from the exhaust outlets 52, 54. It is this exhaust air flow which is the source of excess heat which is recovered and used in the apparatus of the invention.

In the particular embodiment of the device shown in FIG. 3, the carpet extractor apparatus of the invention includes a fluid operated heat exchange means mounted on the base within the bottom compartment 25 in heat transfer relation with the vacuum motors 31, 33 for circulating a fluid heat exchange medium in the vicinity of the vacuum motors. In this way, excess heat generated by the vacuum motors 31, 33 is transferred to the fluid heat exchange medium. The preferred fluid heat exchange medium which is being circulated is a quantity of the cleaning fluid solution which is passing between the solution tank 23 and the cleaning head of the cleaning wand 15, whereby the cleaning solution is preheated by the excess heat generated by the vacuum motors, prior to being circulated past the main heater unit (29 in FIG. 2).

In the preferred embodiment of the invention illustrated in FIG. 3, the fluid operated heat exchange means comprises a pair of separate copper tube coils 43, 45 each of which has an internal diameter or opening 47 which is sized to allow the tubing coil to be closely received about an exterior region of the associated vacuum motors 35, 37. However, it will be understood that the heat exchange coils 43, 35 could also be located in other locations with respect to the vacuum motors and still pick up the excess heat being generated by the motors.

The fluid heat exchange means further comprises a fluid conduit which is connected to the tubing coils 43, 45 for routing the heat exchange medium to and from the coils. As shown in FIG. 3, the fluid conduits 49, 51 are plumbed into the path of the cleaning solution which is passing between the solution tank 23 and the cleaning head 19 of the wand, whereby the cleaning solution is heated by the excess heat generated by the vacuum motors 31, 33. In this way, the same fluid pump 27 which is used to pump cleaning solution from the solution tank to the wand head is utilized to pump cleaning solution through the conduits 49, 51 and through the heat exchange coils 43, 45. The exact form of the heat exchange apparatus may vary. For example, in the embodiment shown in FIG. 3, there are auxiliary heat exchange loops 53 located within the bottom compartment 25 in line with the fluid conduit 51. Other heat exchange coil arrangements can be visualized which could be located within the bottom compartment 41 for effecting heat transfer between the cleaning solution and the hot air within the compartment.

With reference now primarily to FIGS. 2 and 4, it will be appreciated that the improved cleaning extractor apparatus of the invention has an improved filtration system provided as a part of the solution tank for filtering recovered cleaning solution to be reused. As shown in FIG. 2, the filtration system includes a first multi-component filter assembly (designated generally as 55) which is in fluid communication with the head of the cleaning wand by means of an inlet 57. The first multi-component filter assembly 55 is supported on a filter support which extends downwardly into the solution tank. In the example illustrated, the support includes a basket 59 which receives a disposable fabric or paper filer element 61. For instance, the filter element 61 could be formed of CEREX®, spunbonded nylon fabric. Other materials, such as polytetrafluroethylene film filters and the like could also be utilized. Above the fabric filter element 61 is located a gross debris filter 63 which sits just below the opening cover member 65 and seal element 67. The first multi-component filter assembly filters relatively larger particles from the cleaning solution, including dirt and debris.

The improved filtration system of the invention also includes a second filter component 69 which is mounted entirely within the solution tank. The preferred second filter component is a replaceable cannister style filter housing a pleated, treated paper type filter material which filters particles from the cleaning solution and dirt of a smaller size than the particles filtered from the first multi-component filter assembly. This filter generally filters particles down to about a 5 micron size in one exemplary version of the device.

It will be appreciated from FIGS. 2 and 4, that the solution tank 23 has a top wall 71, a bottom wall 73, and opposing sidewalls, e.g., 75, which together define a closed interior 77. The top wall 71 (see FIG. 2) includes openings 79, 81, respectively, for accessing both the first multi-component filtration assembly 55 and the second filter component 69 to allow replacement as needed. A lid member 83 and seal ring 85 are provided to cover the second filter opening 81. The first multi-component filter assembly which serves as an initial filter stage, can be changed without draining cleaning solution from the solution tank 23. It will generally be changed after each cleaning operation (and can be changed during the cleaning operation). The second filter component 69, which serves as the final filter, does not require as frequent a change and will generally be changed out only once a day of operation.

Figure 5:
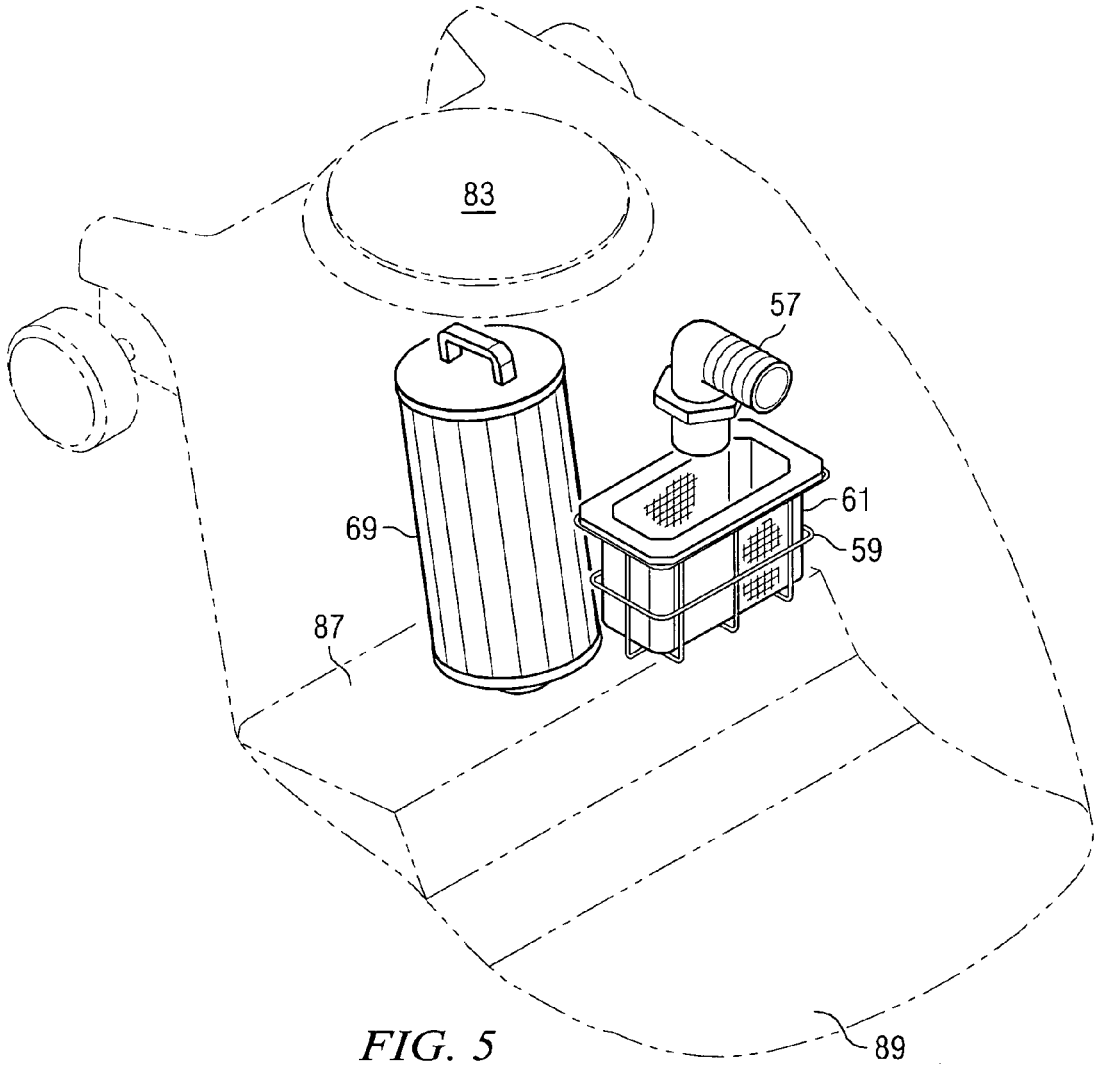
FIG. 5 is a simplified view of the first multi-component filter assembly and of the second filter component, showing the relative placement of these elements with respect to the solution tank, the tank being shown in phantom lines for ease of illustration.

As can perhaps best be seen in FIG. 4, the bottom wall 73 of the solution tank 23 slopes on a grade from a relatively higher horizontal plane to a relatively lower horizontal plane which is equipped with a drain opening. For example, in the version of the apparatus illustrated in FIGS. 4 and 5, the solution tank bottom wall slopes from a relatively higher rearward extent 87 to a relatively lower forward extent 89 thereof, the forward extent 89 thereof containing a drain opening 91 for the tank. The sloping bottom of the solution tank creates a depth difference in the tank interior. The sloping region of the bottom wall is indicated generally at 89 in FIG. 5. As a result of the difference in elevation of the bottom wall, the second filter component (69 in FIG. 4) is mounted on the relatively higher region 87 of the bottom wall where it contacts less dirt and debris collecting at the drain opening 91. This placement of the second filter component 69 has been found to alleviate certain problems with the second filter component clogging which occurred on occasion in the past. While the slope illustrated in FIGS. 4 and 5 of the drawings is from back to front, it will be appreciated that the slope could have been from front to back, or even from side to side, as long as a grade in the horizontal level exists in the tank bottom wall.

The apparatus of the invention can be provided with a number of operator conveniences. For example, with reference to FIG. 4 of the drawings, it will be noted that the handle region 93 is provided with a pair of rollers 95 which aid in loading and unloading the apparatus during use, for example, from the rear cargo region of a vehicle.

In the method of cleaning a carpeted surface of the invention, a carpet extractor apparatus of the type previously described is provided. The cleaning solution is dispensed from the solution tank 23 in a fluid dispensing operation while moving the cleaning head 19 of the wand 15 in a first direction relative to a user. The fluid dispensing operation is then stopped, followed by moving the cleaning head 19 in an opposite direction relative to the user while applying a vacuum to the cleaning head 19 to recover cleaning solution from the surface being cleaned to the solution tank 23. The heat created by the vacuum motors 31, 33 is used to heat the cleaning solution by circulating the cleaning solution in a fluid path in the vicinity of the vacuum motors, whereby excess heat generated by the vacuum motors 31, 33 is transferred to the cleaning fluid. Fluid entering the inlet 57 to the solution tank 23 first passes through the gross debris element 63 and then through the filter element 61 contained in the support basket 59. Prior to leaving the solution tank and being reused, the cleaning solution passes through the second filter component 69 which filters out the smaller particles of dirt and debris.

An invention has been provided with several advantages. The separation of the solution tank openings on the top wall of the tank provides greater ease in filter changes. There is provided a primary opening for the more frequent filter (bag filter) change and a secondary opening for the daily filter (final filter) change. If desired, the final filter can be cleaned and reinstalled through the secondary opening. Providing access from the top of the solution tank for the bag filter makes for an easier filter change during operation of the apparatus. The change in elevation in the bottom wall of the solution tank and placement of the final filter results in collection of heavier soil near the drain area of the tank. Because of the location of the final (cannister) filter on the relatively higher elevation within the tank interior, it receives less heavily soiled fluid, alleviating filter clogging problems that sometimes existed in the past. The final filter is provided as a cannister with convenient screw-in installation.

The external wheels provided on the handle region of the apparatus assist the operator in loading and unloading the machine, for example, from the cargo region of a truck or van. The unitary shell base works as a chassis for installation of operative components directly onto the base. The use of separate vacuum manifolds saves space within the lower compartment of the base. The fluid heat exchange means provides an auxiliary heating system which provides heat adequate to break down grease and other soil and contaminants to enhance the cleaning process. The side covers of the base can be removed for ease of access to the interior of the apparatus for servicing. The side covers also hold sound deadening foam sheets which decrease noise produced by the apparatus in use. The device is simple in design and extremely dependable in operation and does add significantly to the cost of the extractor.

While the invention has been shown in only one of its forms, it is not thus limited but is susceptible to various changes and modifications without departing from the spirit thereof.

What is claimed is:

1. A portable extractor apparatus used to clean planar surfaces, the extractor apparatus comprising:

a wheel mounted base having at least a solution tank for dispensing and recovering cleaning solution;

the wheel mounted base having an associated cleaning head which contacts the surface to the cleaned for dispensing and recovering cleaning solution;

a fluid pump for circulating cleaning solution in a path between the solution tank and the cleaning head;

at least one vacuum motor which comprises a vacuum source for the extractor apparatus, the vacuum source being in communication with the cleaning head for suctioning the surface being cleaned;

a filtration system provided as a part of the solution tank for filtering recovered cleaning solution to be reused;

wherein the filtration system includes a first multi-component filter assembly in fluid communication with the cleaning head for filtering relatively larger sized particles of dirt and debris from the cleaning solution;

wherein said filtration system also includes a second filter component mounted within the solution tank, the second filter component filtering particles from the cleaning solution and dirt of a smaller size than the particles filtered from the first multi-component filter assembly; and wherein the solution tank has a top wall, a bottom wall and opposing sidewalls which together define a closed interior, and wherein the top wall includes openings for accessing both the first multi-component filtration assembly and the second filter component to allow replacement as needed;

wherein the solution tank bottom wall slopes on a grade from a relatively higher horizontal plane to a relatively lower horizontal plane which is equipped with a drain opening for the solution tank, thereby creating a depth difference in the tank interior, and wherein the second filter component is mounted on the relatively higher plane of the bottom wall where it contacts less dirt and debris collecting at the drain opening.

2. The portable extractor apparatus of claim 1, wherein the solution tank bottom wall slopes from a relatively higher rearward extent to a relatively lower forward extent thereof, the forward extent housing the drain opening for the tank.

3. The portable extractor of claim 1, wherein the cleaning head which is associated with the wheel mounted base is provided as a part of a hand held cleaning wand which is connected to the solution tank by pliable hosing.

4. The portable extractor of claim 1, wherein the cleaning head which is associated with the wheel mounted base is provided as an integral part of the base itself.

5. The portable extractor of claim 1, wherein the first multi-component filter assembly includes an upper element which comprises a debris basket, the upper element supporting a lower element which comprises a fabric type disposable filter element, and wherein the second filter component is a replaceable cartridge type filter element.

6. The portable extractor apparatus of claim 1, wherein the first multi-component filter assembly and the second filter component can be changed out independently of each other.

7. The portable extractor apparatus of claim 1, including a heat exchange element in heat exchange relationship with the fluid passing from the solution tank to the cleaning head for heating the cleaning solution from the solution tank.

8. The portable extractor apparatus of claim 1, wherein the apparatus is a carpet extractor used to extract dirt and debris from a carpeted planar surface.

9. The portable extractor apparatus of claim 1, wherein the apparatus is equipped with a cleaning head which is adapted to clean hard surfaces such as tile floors.

10. The portable extractor apparatus of claim 1, wherein the wheel mounted base includes a motor compartment containing the vacuum motor and solution fluid pump, the solution tank being located above the motor compartment.

11. The portable extractor apparatus of claim 1, wherein the apparatus has a handle extending from a rear region of the solution tank, and wherein the handle carries wheels which aid in loading and unloading the apparatus during use.

* * * * *